United States Patent [19]

Downs

[11] 4,230,000

[45] Oct. 28, 1980

[54] AUTOMATIC GRIPPER FOR CAPS TO BE REMOVED FROM JARS

[76] Inventor: Edgar S. Downs, 6530 Huntley Rd., Worthington, Ohio 43085

[21] Appl. No.: 60,779

[22] Filed: Jul. 26, 1979

[51] Int. Cl.[3] ..... B67B 7/08

[52] U.S. Cl. ..... 81/3.2

[58] Field of Search ..... 81/3.1 B, 3.2, 3.3 R, 81/3.31, 3.45; 51/381 R

[56] References Cited

U.S. PATENT DOCUMENTS

| | | | |
|---|---|---|---|
| 1,834,307 | 12/1931 | Halstead et al. | 81/3.3 R |
| 1,953,412 | 4/1934 | Killman | 81/3.3 R |
| 3,037,407 | 6/1962 | MacLaren | 81/3.2 |
| 3,724,296 | 4/1973 | Graver | 81/3.3 R |
| 3,942,395 | 3/1976 | Lepage et al. | 81/3.2 |

*Primary Examiner*—James G. Smith

*Attorney, Agent, or Firm*—William V. Miller

[57] ABSTRACT

A gripper which automatically grips the screw cap on a jar or the like when it is moved thereinto in order to facilitate removal of the cap. It includes a motor-operated clamp which is automatically actuated by movement of the capped jar thereinto to grip the cap and suspend the jar so that, thereafter, both hands of the user are free to grip the jar and turn it relative to the clamped cap. After the jar is separated from the clamped cap, the motor may be actuated to release the cap from the clamp.

20 Claims, 12 Drawing Figures

AUTOMATIC GRIPPER FOR CAPS TO BE REMOVED FROM JARS

BACKGROUND OF THE INVENTION AND PRIOR ART

Many jar openers have been provided in the past and have usually embodied unmounted clamps which require the use of two hands, the clamp being normally operated by the right hand while the jar is held by the left hand. The main difficulty usually is in holding the jar with the one hand. This is increased when one or both of the hands is weakened due to injury or disease. Clamps have been devised which are mounted and clamp the jar to suspend it to free both hands for turning the jar relative to the cap. However, these usually require considerable effort and skill with the hands to initially operate the clamp to grip the cap and suspend the jar. Illustrative of this type of device are U.S. Pat. Nos. 3,724,296; 1,953,412 and 1,834,307.

SUMMARY OF THE INVENTION

The present invention provides a gripper which serves to grip the screw cap or lid on a jar or bottle or other container and suspend the container so that it can be gripped to rotate it relative to the container for separation of the cap and container. In the following description, reference will be made to a screw cap and jar but the invention is applicable to any container or closure which must be relatively rotated for opening the container.

The device comprises a clamp located on the underside of a suitable support and including relatively movable jaws. The jaws are moved automatically into clamping relationship merely by moving the capped jar into the clamp so it engages a switch to start a drive motor which rotates a screw operatively connected to the clamp. This will suspend the jar so it can be gripped to rotate it relative to the cap. Both hands will be free to grip the jar with the ordinary user but even if only one hand is usable, the jar can be firmly gripped for turning. The cap can be released from the clamp merely by operating a motor-reversing switch. Thus, no difficult force-requiring mechanical clamp means need be operated by the user and the user's hands or hand is freed to turn the gripped jar.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
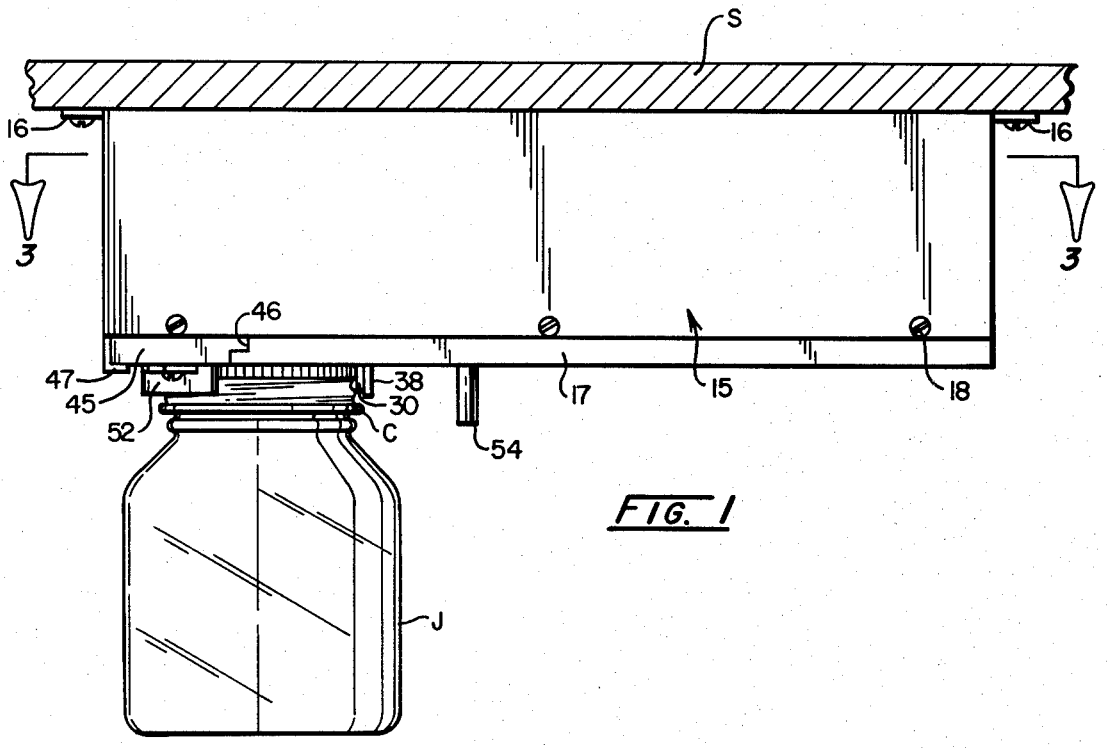
FIG. 1 is a side elevational view of the cap gripper according to this invention, showing it gripping a screw cap on a jar to suspend it.

With specific reference to the drawings, in FIGS. 1 and 2, the device of this invention is shown generally and includes an elongated housing 15 suspended below a suitable support S which for example, could be the underside of a kitchen counter, being fastened thereto by means of flanges 16 and screws passed upwardly therethrough. In FIG. 1, a jar J is shown suspended from the device by its screw cap C as an example of the use of this device. The housing 15 has a removable base plate 17 at its lower side which is normally held in horizontal position within the lower edges of the adjacent vertical walls by screws 18 and provides a lower exposed cap-contacting surface.

Figure 2:
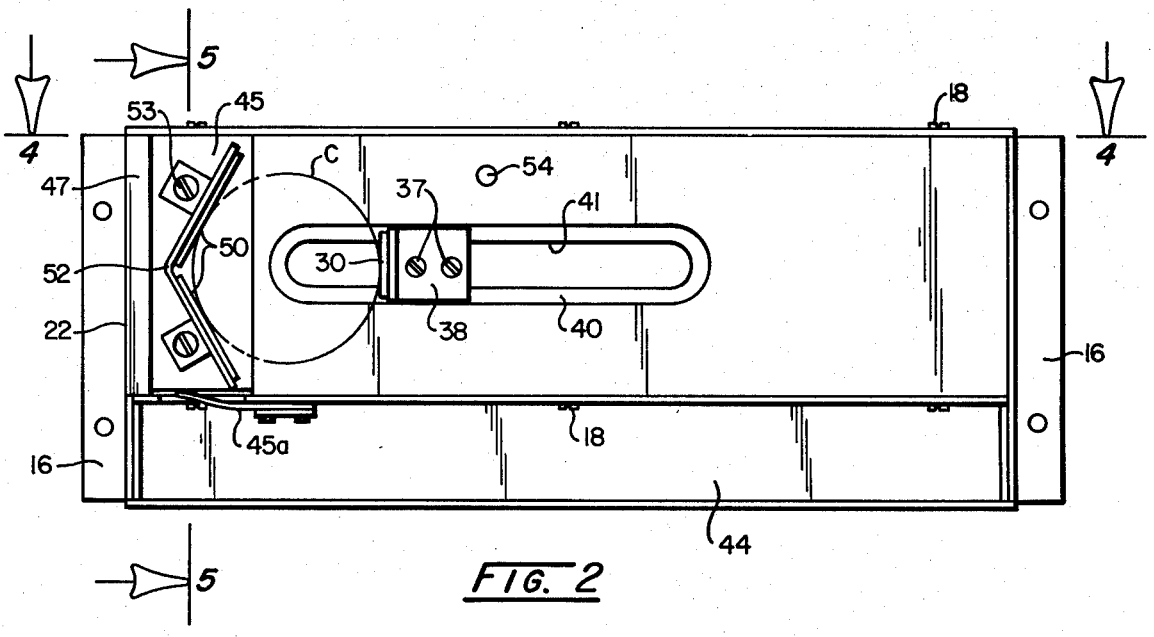
FIG. 2 is a bottom view of the gripper of FIG. 1 showing the jar in cap-clamped position.
Figure 3:
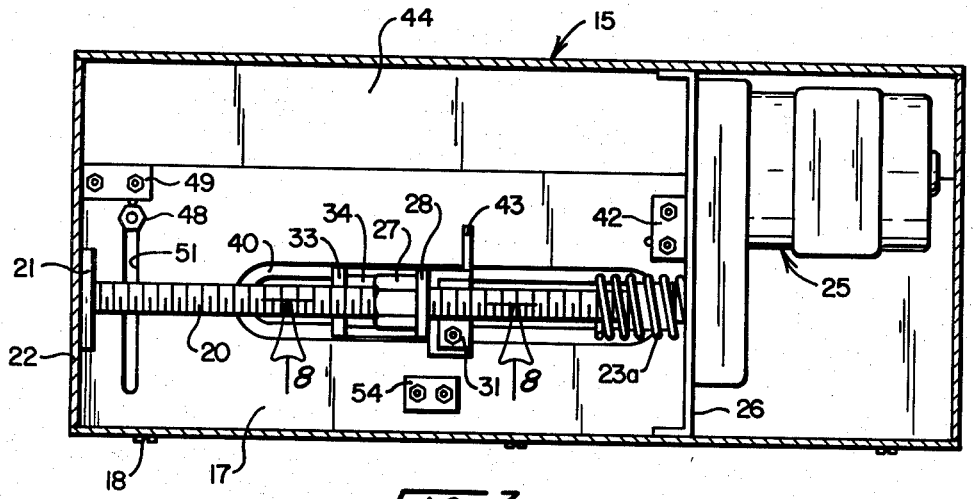
FIG. 3 is a longitudinal horizontal sectional view taken along line 3—3 of FIG. 1.
Figure 8:
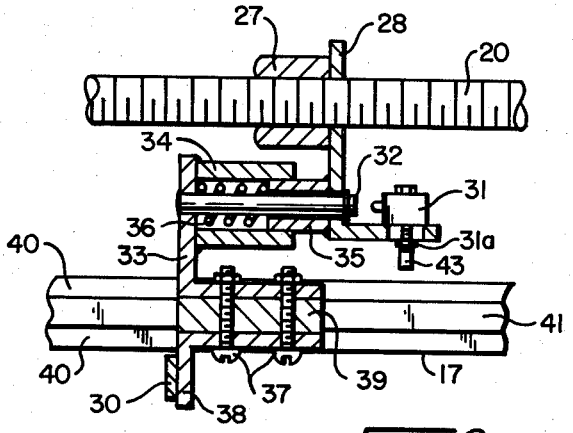
FIG. 8 is an enlarged view of a limit switch and mount taken on line 8—8 of FIG. 3.
Figure 9:
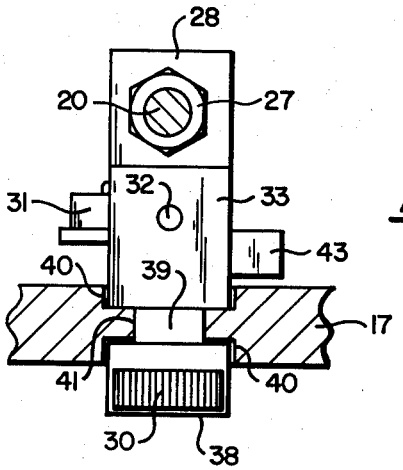
FIG. 9 is a transverse sectional view taken along line 9—9 of FIG. 4.

Rotatably mounted within the housing 15 and extending longitudinally thereof, a shown in FIGS. 2 and 3, is a feed-screw 20. One end of the screw is carried by a bearing 21 on one end wall 22 of the housing and the other end is coupled by a coupling 23 to the output shaft of a combined reversible electric motor and gear reduction unit 25. This unit is supported by an adjacent intermediate transverse wall 26. The screw 20 receives a nut 27 threaded thereon which carries a depending support bracket 28 which is part of the assembly adapted to mount the movable jaw 30 of the cap-clamping-means of this device. Details of this assembly are shown in FIGS. 8 and 9.

This jaw-mounting assembly comprises the bracket 28 which is L-shaped and depends from the nut 27 to which it is fixed. On the horizontal part of the bracket, which extends to the right (FIG. 8) is a limit switch 31, the button of which is adapted to be engaged at times by the head of a pin 32 from which it is normally spaced. This pin is axially fixed in the upstanding part of an L-shaped bracket 33. This part of the bracket carries a tubular spring-socket 34, opening to the left toward bracket 28 and slidably receiving opposed tubular guide 35 which is fixed on bracket 28 and telescopes within socket 34, engaging the outer end of a compression spring 36 disposed therein. Pin 32 is slidable axially in guide 35 to contact the button of switch 31. This switch is adjustably mounted on bracket 28 to vary the point of contact by a depending bolt 31*a* and cooperating slot. The lower horizontal arm of the L-shaped bracket 33 has bolted thereto, by clamping bolts 37, an inverted L-shaped bracket 38 with a spacer and guide 39 therebetween. This guide 39 operates in an elongated guide slot 41 formed in the plate 17 and which is recessed at 40 at its upper and lower surfaces at the slot to receive the respective brackets 33 and 38. The cap-engaging jaw 30 is serrated or otherwise roughened and it will be apparent that its support assembly will reciprocate in the slot 41 upon rotation of the feed screw 20 in opposite directions. Jaw 30 may be of rigid material but is preferably of resiliently compressible material to prevent injury in case fingers are caught thereby. Another limit switch 42 is supported by the intermediate transverse wall 26 so that, as the motor unit 25 reverses the screw 20, a lug 43, depending from bracket 28, engages and actuates switch 42 to stop the motor unit in its retracting movement of jaw 30. A cushioning coil spring 23*a* surrounds the coupling 23 and adjacent end of screw 20 to engage and cushion bracket 28 and tend to start its return.

It will be noted that the plate 17 covers only part of the bottom side of the housing 15, and the remaining rear portion is covered by a fixed lower wall 44.

Figure 4:
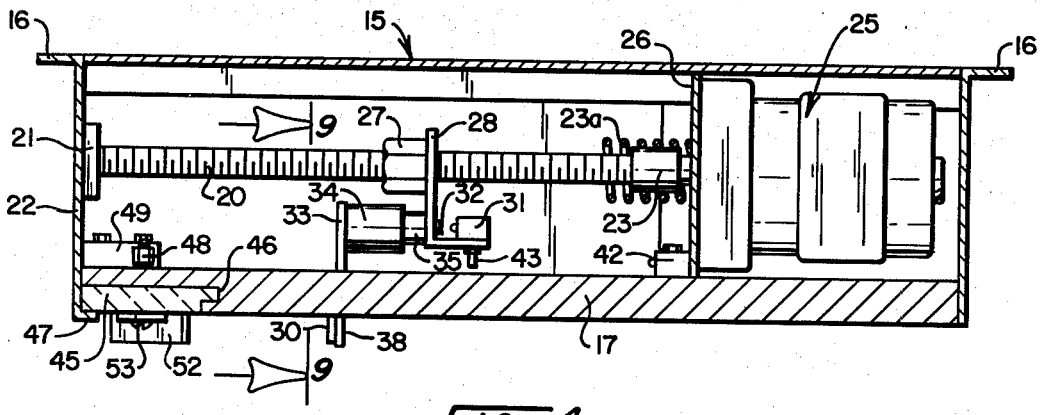
FIG. 4 is a longitudinal vertical sectional view taken along line 4—4 of FIG. 2.
Figure 5:
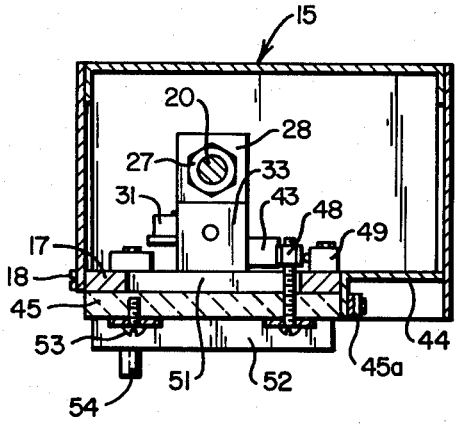
FIG. 5 is a transverse vertical sectional view taken along line 5—5 of FIG. 2.
Figure 7:
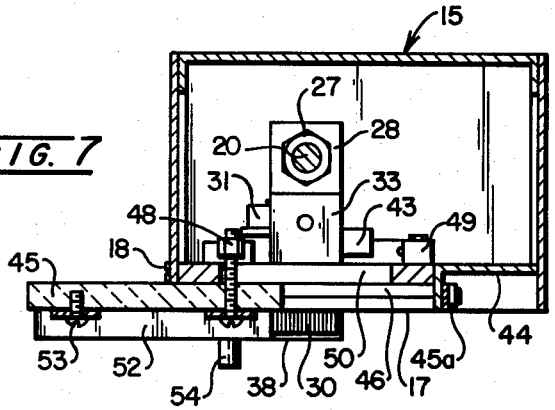
FIG. 7 is a transverse sectional view taken along line 7—7 of FIG. 6.
Figure 6:
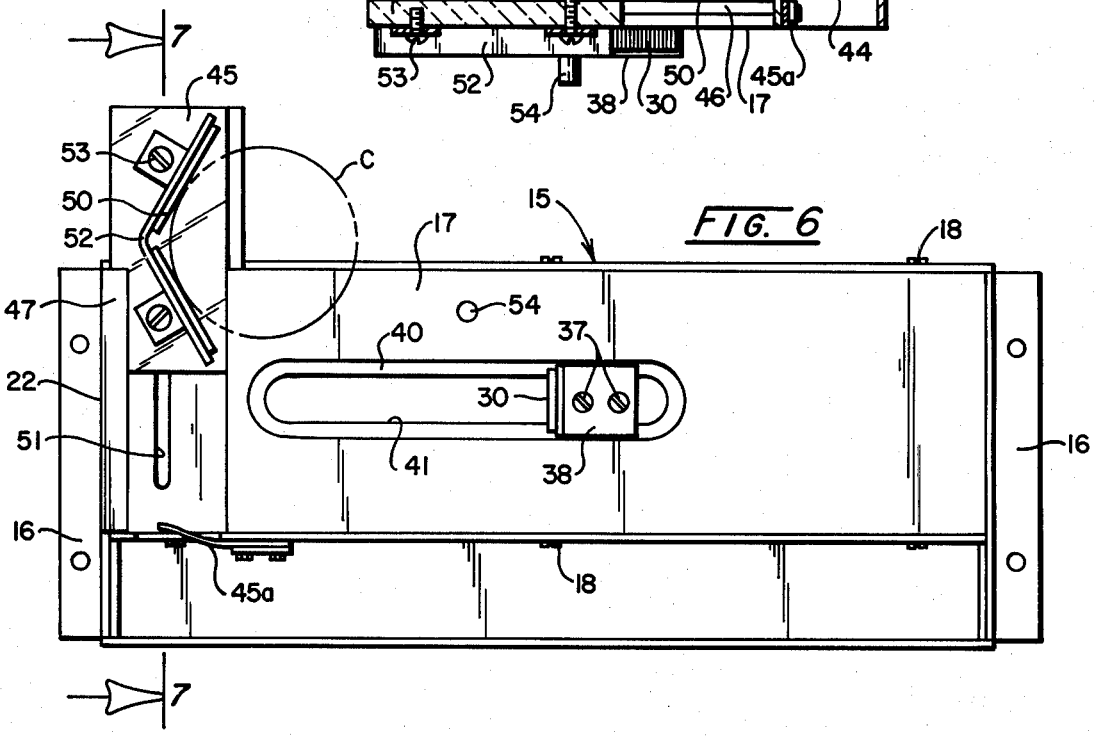
FIG. 6 is a bottom plan view indicating the jar being inserted for clamping the cap.

The other jaws of the cap-clamping means are carried by a transverse slide 45 mounted at the lower surface of the plate 17 beyond the outer or forward end of the slot 41 as indicated in FIGS. 2, 4 and 6. The slide 45 is in the form of a small plate, preferably transparent, mounted in a guide formed by a transverse recess in the bottom of plate 17 at the one end thereof, one edge of the slide having a tongue fitting into a guide groove 46 in plate 17 and the other edge being retained by a flange 47 on the lower edge of housing end wall 22. The slide carries an upstanding bolt 48 at its inner end which, when the slide moves to its innermost position, as shown in FIG. 5, engages a limit switch 49 that is carried by the housing end wall 26, the bolt moving in a transverse slot 51 in the plate 17.

The other cap-engaging jaws are, as indicated, carried on the lower side of the slide 45 and comprise two jaw members 50 which are supported in diverging relationship by a V-shaped support clip 52 secured to the slide by screws 53. These jaws may have serrated or roughened contact surfaces if desired. They are arranged in a V which will open toward jaw 30 when the slide 45 is in its inner-most position. In this position the jaws of screw 20 bisects the V.

Another push-button start switch 54 is located on the base plate 17 of the housing adjacent slide 45 so it can be engaged by a finger of the hand which pushes the slide 45 inwardly. This switch when actuated will release the cap-clamp.

The slide 45 is especially useful when the device is located under a counter where it cannot be seen readily. Assuming the motor unit 25 is stopped, the jaw 30 is retraced and the slide 45 is in its outermost position shown in FIG. 6, the jar J will be slipped beneath the slide and laterally so that the cap C will move into the diverging jaws 50. This operation can be seen through the transparent slide. Then the slide 45 will be pushed inwardly to the position shown in FIG. 2 moving the bolt 48 therewith until it strikes the switch 49 to energize the motor unit 25. A cushioning leaf spring 45*a* is mounted on wall 44 to be engaged by the inner end of slide 45 as it moves into its innermost position and will tend to return to slide. Energizing unit 25 will rotate the screw 20 and cause it to feed or advance the nut 27 and associated assembly outwardly until the jaw 30 engages the cap C at a point opposite the converging point of the V-arranged clamps 50. The engagement will be with a resilient force because of the spring 31. When the engagement of the cap C by the opposed jaws 50 and 30, against the cushioning effect of spring 36, is sufficient, the pin 32 will engage and actuate switch 31, which will deenergize the motor unit 25. Now the jar will be suspended so that it can be gripped readily with one or both hands and turned relative to the cap.

When the cap is to be released, it is merely necessary to push the switch 54 to reverse the unit 25 to cause screw 20 to reverse and retract the clamp 30 from jaws 50. This retraction will continue until the lug 43 strikes switch 42 to deenergize motor unit 25. The slide 45 is pulled outwardly and the switch 49 is opened.

Figure 10:
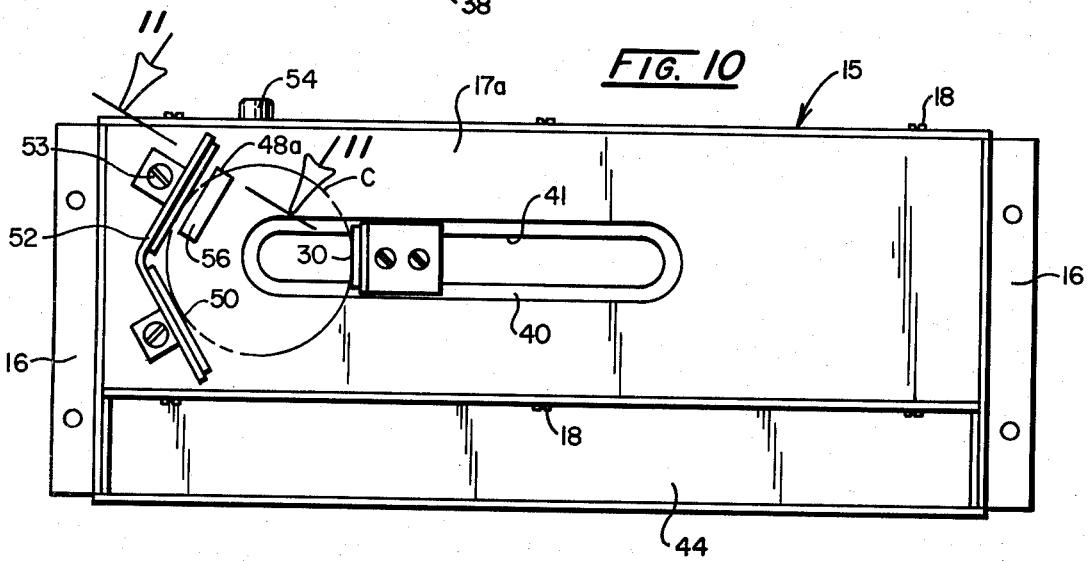
FIG. 10 is a bottom view of a modified form of the cap gripper.
Figure 11:
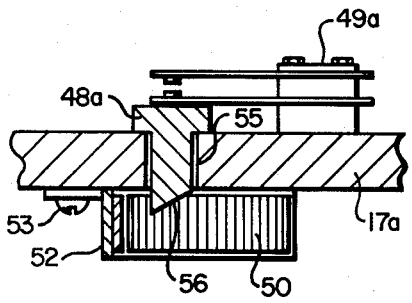
FIG. 11 is an enlarged vertical sectional view taken along line 11—11 of FIG. 10.

In FIGS. 10 and 11, a cap-gripping device is illustrated which is exactly the same as that previously described except that the slide 45 is eliminated. In this instance, the jaws 50 are fastened directly to the lower surface of a plate 17*a* which does not have the transverse recess therein for receiving the slide 45. Adjacent the outermost of the jaws 50 is a trigger 48*a* which is mounted for vertical movement in an opening 55 in the plate 17*a*. The top of the trigger engages one spring contact of a pair of switch contacts which are normally separated and which provide a switch 49*a* connected to the motor unit 25. The lower edge of trigger 48*a* is provided with a cam surface 56. To start the device, the jar is moved beneath the plate 17*a* and then the cap C is pushed laterally into the V formed by jaws 50. As the cap C moves into final clamping position, the cam surface 56 is engaged and the trigger 48*a* is moved upwardly to start the motor unit 25. As soon as the cap is removed, the switch 49*a* is opened.

Figure 12:
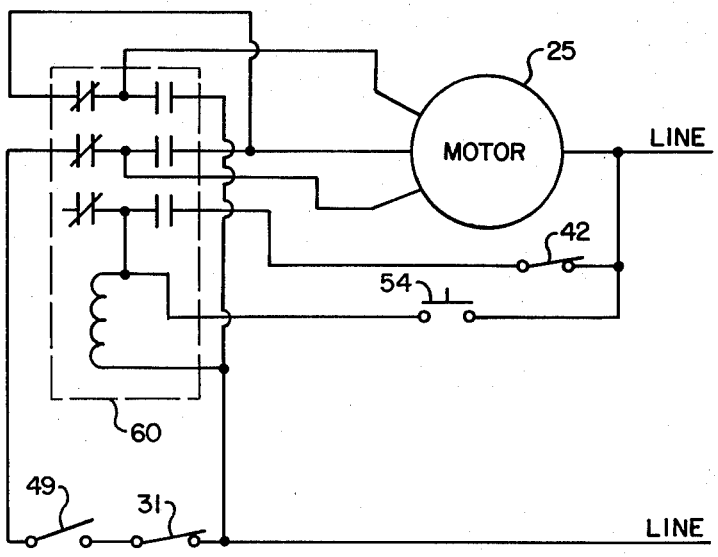
FIG. 12 shows an electric circuit for the gripper.

A suitable electric circuit for both forms of the device is illustrated in FIG. 12. It includes the motor 25, the start switch 49 or 49*a*, the limit switch 31 to control the clamping pressure on the cap, the clamp-retracting push-bottom switch 54, a holding relay 60, and a limit switch 42 to stop the retracting movement. Relay 60 supplies current to the motor unit 25, once the switch 54 is pushed to reverse the motor, until the limit switch 42 is actuated, so that full retraction of clamp jaw 30 occurs.

It will be apparent that this invention provides a simple device which will be actuated, merely by insertion of the capped jar, to grip the cap and suspend the jar so it can be easily gripped with one or both hands to turn it. Little effort and skill is required to operate the device.

The jar cap will be firmly gripped but with resilient pressure to prevent damage and this pressure can be varied by a simple adjustment.

Having thus described this invention what is claimed is:

1. A device for gripping the cap of a capped jar to facilitate turning of the jar relative to the cap, comprising a cap-contacting surface for engaging the outer surface of the cap, jaws at said surface and relatively movable towards and away from each other to clamp and release the cap, means for producing the relative movement comprising a screw operatively connected to the jaws and means for driving the screw, and trigger mechanism engaged by the cap as it is positioned in engagement with said surface and at least one of the jaws to actuate said driving means.

2. A device according to claim 1 in which a pair of jaws are arranged in a relatively fixed operative position in diverging reltionship at said surface and a movable jaw moves towards and from said diverging jaws, said movable jaw being mounted on the screw and the driving means therefor being a reversible electric motor, said trigger mechanism being located at said diverging jaws so that when the cap is moved thereinto it engages said trigger mechanism to actuate a first start switch connected in circuit with said electric motor.

3. A device according to claim 2 in which said contact surface faces downwardly and the jaws depend therefrom so that when the cap is gripped the jar will be suspended.

4. A device according to claim 3 in which means resiliently mounts the movable jaw on the screw so that the cap is gripped with a cushioning force.

5. A device according to claim 4 in which a limit switch connected in the motor circuit with said mounting means to stop the motor in order to limit movement of said movable jaw in the gripping direction toward the other jaws.

6. A device according to claim 5 in which the switch is adjustably supported on the mounting means to vary the point of engagement as the resilient mounting means yields.

7. A device according to claim 5 including a second start switch connected in the motor circuit to be selectively actuated to reverse it and the feed screw in order to retract the movable jaw mounting, a limit stop switch connected in the motor circuit and engaged by the mounting to stop the reversing action.

8. A device according to claim 7 including a holding relay connected in the motor circuit to supply current to the motor after the second start switch is actuated until the last-named stop switch is engaged.

9. A device according to claim 8 including cushioning means mounted at the feed screw for engaging said mounting means as it engages said limit stop switch.

10. A device according to claim 7 in which said diverging jaws are mounted on a transversely movable side forming part of said contact surface for movement from an outward exposed position to an inner operative position where the diverging jaws open toward the movable jaw, said trigger mechanism comprising a trigger mounted on the slide which engages said first start switch when the slide is moved to its operative position.

11. A device according to claim 10 in which the slide is transparent.

12. A device according to claim 10 in which a cushioning spring is mounted adjacent said slide to engage it as it moves into its inner position.

13. A device according to claim 1 comprising an elongated housing adapted to be secured beneath a support and having a removable base plate at the lower side of the housing with said cap-contacting surface being its bottom surface, said jaws at said surface comprising a pair of jaws which diverge in V-relationship and when in operative position depend from said surface and open toward a movable jaw carried by said screw, said screw being mounted for rotation within the housing above the base plate longitudinally thereof and spaced above the base plate, said means for driving the screw comprising an electric motor unit mounted within the housing, said movable jaw being carried by a bracket assembly supported by a nut mounted on said screw and depending through a longitudinal slot in the base plate so that the movable jaw will depend from said contact surface, the axis of the slot and the axis of the screw being in the same plane which is in bisecting relationship to the V-relationship of the jaws, said trigger mechanism being located so that when the cap is positioned in the V-relationship jaws in operative position it engages said mechanism, a first start switch actuated by said trigger mechanism connected in circuit with said motor, said movable jaw being resiliently mounted on said bracket assembly so that as the jaws grip the cap, there is a cushioning effect, and a first stop switch connected in the motor circuit for limiting the gripping action.

14. A device according to claim 13 in which the bracket assembly comprises a bracket part carrying the jaw and a bracket part carrying the stop switch which are mounted for relative movement, and a cushioning spring therebetween resisting that movement.

15. A device according to claim 10 including means for supporting the stop switch on the bracket part for adjustment axially of the screw.

16. A device according to claim 14 in which a second start switch with a holding relay for selectively reversing the motor and a second stop switch are connected in the circuit, the stop switch being mounted along the screw at the desired point of retraction of the movable jaw to be engaged by its mounting bracket assembly.

17. A device according to claim 16 including a cushioning coil spring on the screw for engaging the mounting means as it nears the extent of its retraction.

18. A device according to claim 16 in which the V-relationsip jaws are mounted in a depending position on the lower surface of a slide, said slide being mounted in a recess in said base plate for transverse movement so that when in operative position its lower surface is a continuation of the lower surface of the base plate, said slide carrying the trigger mechanism for actuating said first start switch.

19. A device according to claim 18 in which the V-relationship jaws are secured in a depending position on the lower surface of the slide, said slide being transparent.

20. A device according to claim 18 including a cushioning leaf spring mounted on said base plate for engaging the slide at its inner end as it moves into operative position.

* * * * *